US005214228A

United States Patent [19]

Hoiles et al.

[11] Patent Number: 5,214,228

[45] Date of Patent: May 25, 1993

[54] ELECTRONIC METRONOME

[76] Inventors: Kent L. Hoiles, 9531 Fostoria Rd., Bradner, Ohio 43406; Douglas Mansor, 7206 Brint Rd., Sylvania, Ohio 43560

[21] Appl. No.: 331,225

[22] Filed: Mar. 31, 1989

[51] Int. Cl.[5] ..... G04F 5/02

[52] U.S. Cl. ..... 84/470 R; 84/484; 84/636; 84/652; 84/668; 84/DIG. 12

[58] Field of Search ..... 84/470 R, 484, DIG. 12, 84/612, 636, 652, 668, 714

[56] References Cited

U.S. PATENT DOCUMENTS

| | | | |
|---|---|---|---|
| 4,014,167 | 3/1977 | Hasegawa et al. | 84/DIG. 12 X |
| 4,193,257 | 3/1980 | Watkins | 84/484 |
| 4,380,185 | 4/1983 | Holcomb | 84/DIG. 12 X |
| 4,583,443 | 4/1986 | Senghaas et al. | 84/484 |

*Primary Examiner*—Emanuel T. Voeltz
*Attorney, Agent, or Firm*—Willian Brinks Olds Hofer Gilson & Lione

[57] ABSTRACT

An electronic metronome includes an adjustable oscillator driving a first frequency divider, a crystal time base driving a second frequency divider for generating a pair of audible frequencies, a standard pitch frequency and reference (time base) frequencies, a frequency counter coupled to the output of the adjustable oscillator for counting the output of the adjustable oscillator, a digital display and display stabilizer circuitry for displaying the count of the frequency counter, a gate driven by the first frequency divider for programmably serially selecting one of the pair of audible frequencies at a rate determined by the output of the frequency divider, a selector switch, three visual indicators, and a programmable counter coupled to the selector switch and visual indicators for providing various sequential time signature displays and an audio amplifier and speaker for providing an audible beat patterns. The metronome may be adjusted to provide a wide range of beats per minute which is displayed on the digital display. Various beats per measure patterns such as single meter, duple meter, and up to and including sextuple meter are displayed in various distinct patterns by the three visual indicators with accompanying distinct audible rhythms.

20 Claims, 3 Drawing Sheets

ELECTRONIC METRONOME

BACKGROUND OF THE INVENTION

The present invention relates to metronomes and more specifically to electronic metronomes which provides a digital readout of beats per minute, an audible tick-tock rhythm and various visual pattern displays corresponding to certain available beats per measure time signatures.

Metronomes are constant companions to the music student and musician. The maintenance of constant tempi through practice and inculcation is known to the youngest student and most accomplished professional.

Conventional metronomes are mechanical devices having timing mechanisms which resemble that of an inverted pendulum clock. That is, an escapement mechanism is controlled by a pendulum arm pivoted at its lower extremity which includes a weight longitudinally movable therealong. The selected position of the metronome weight determines the oscillatory frequency of the pendulum and thus the tempo of the metronome. Such a device is generally disclosed in U.S. Pat. No. 3,724,203.

The advent and application of electronic circuitry to the metronome has brought not only significant change to the basic device but also expansion of its capabilities. Metronomes incorporating digital displays of tempo and which produce audible as well as visually perceptible beats are known in the art. For example, U.S. Pat. No. 4,018,131 discloses an electronic metronome capable of providing audibly distinct subdivisions and cross rhythms. No visual indication is provided by the device therein disclosed, however.

Visual outputs are, however, provided in the devices disclosed in U.S. Pat. Nos. 4,014,167 and 4,193,257. In the former patent, a metronome is capable of providing audible and visual display of downbeat and medial beat sound or combinations thereof. In the latter patent, upbeat and downbeat visual indications as well as an audible output which provides emphasis of downbeat are provided. A digital readout of the selected tempo is also displayed.

U.S. Pat. Nos. 4,090,355 and 4,204,400 disclose additional electronic metronomes having distinct downbeat and upbeat displays which vary, for example, by color or duration.

U.S. Pat. No. 3,818,693 discloses a metronome wherein the beat pattern is intended to duplicate that pattern described by a band or orchestra leader's hand. Thus, the face of the metronome includes four spaced-apart displays arranged in a pattern of the quarter hours of a clock face.

Whereas these metronomes individually provide various features such as digital tempo display and various beat pattern outputs, none teach a device which provides the most desirable characteristics, namely, an authentic tick-tock audible output, a digital display and selectable visual beat patterns coupled with a high accuracy time base. Thus, improvements in the art of electronic metronomes are not only possible but desirable.

SUMMARY OF THE INVENTION

An electronic metronome according to the present invention includes an adjustable oscillator or timer which provides a variable frequency or pulse train output. The frequency of the output is adjusted by adjusting a control voltage supplied to the oscillator. A two-position range switch provides a first, adjustable lower range of output frequencies from the oscillator and a second, adjustable higher range of output frequencies. The output from the oscillator is provided to a binary counter which is configured to divide the output of the adjustable oscillator by 3,300. The resulting signal is the beats per minute frequency or pulse train utilized to key and index other metronome circuits.

The metronome also includes a crystal oscillator. The output of the crystal oscillator is likewise subdivided by a second binary counter. Five signals or outputs are derived from the crystal oscillator by the second binary counter: a first audible frequency, a second audible frequency an octave higher than the first audible frequency, a musical pitch reference frequency and a two time base reference frequencies against which the beats per minute signal is compared.

Such comparison occurs in a three digit BCD counter which receives the time base and beats per minute signals. The beats per minute signal is likewise supplied to comparator and latch circuits. The comparator and latch circuits stabilize the display and provide an update signal to frequency counter and decoder driver circuitry. The frequency counter and decoder driver circuitry in turn drive a three digit, seven-segment light emitting diode display of the actual beats per minute count.

A selector switch provides various modes of operation and visible and audible outputs. In one switch position, the reference pitch frequency is provided to the input of an audio amplifier which drives a loudspeaker. In other positions, the selector switch selects various beats per measure (time signature) patterns such as single meter, duple meter, triple meter, quadruple meter and sextuple meter. A logic gate provides certain patterns of high and low frequencies to the amplifier and loudspeaker which emphasize the selected time signature. A counter and divider decoder circuit in conjunction with a diode array drives three distinctly colored light emitting diodes. The light emitting diodes are illuminated in various patterns corresponding to a selected beats per measure (time signature) position of the selector switch.

Thus it is an object of the instant invention to provide an electronic metronome which utilizes a crystal controlled reference time base.

It is a further object of the present invention to provide an electronic metronome having an adjustable beats per minute output which is displayed on a digital readout.

It is a further object of the instant invention to provide an electronic metronome having a two pitch audible output which provides various beat patterns for various time signatures.

It is a still further object of the instant invention to provide an electronic metronome having distinctly colored light emitting diodes which provide various color and position patterns for various time signatures.

Further objects and advantages of the instant invention will become apparent by reference to the following description of the preferred embodiment and attached drawings.

DESCRIPTION OF THE PREFERRED EMBODIMENT

Figure 1:
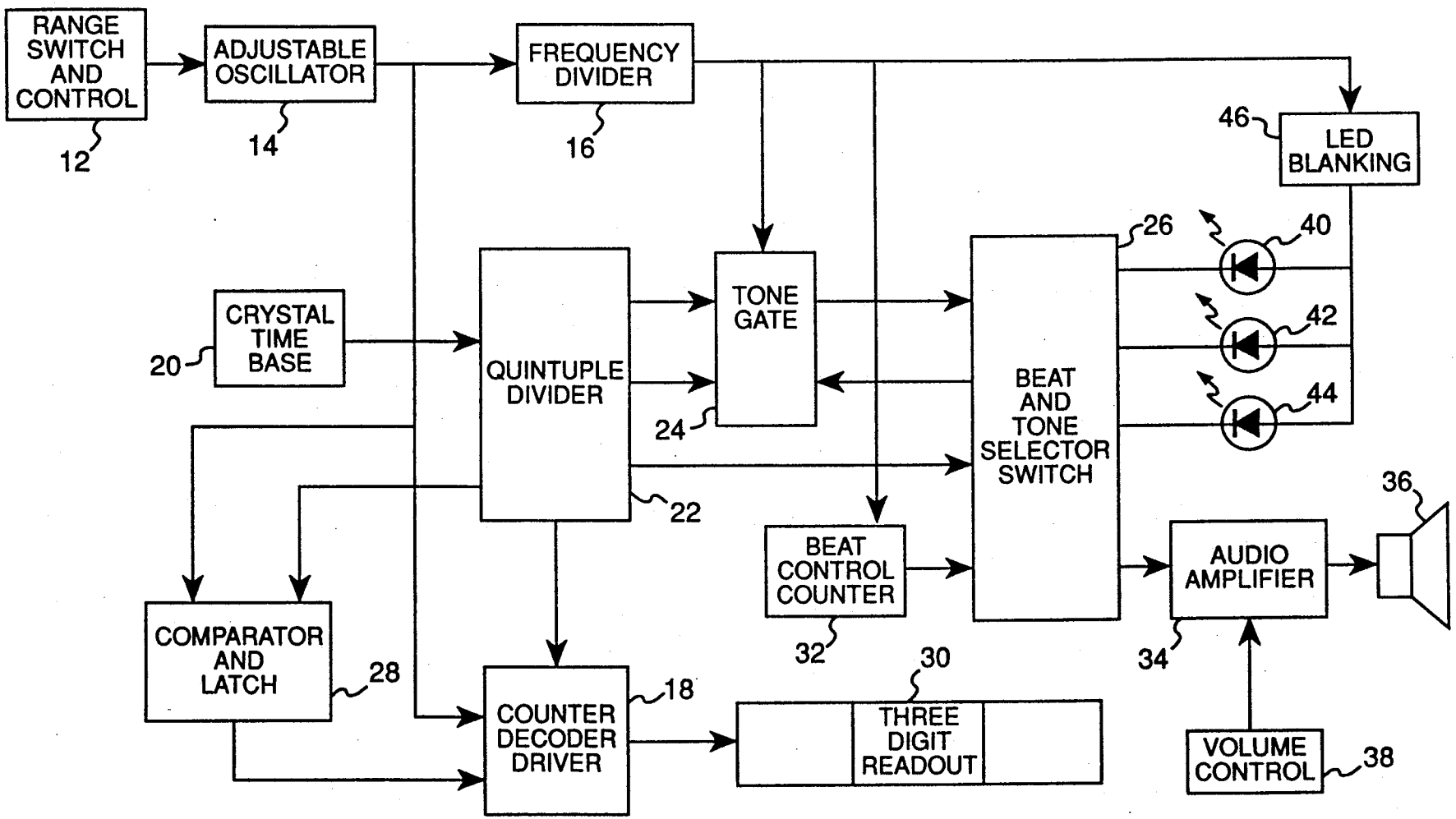
FIG. 1 is a block diagram of the circuitry of an electronic metronome according to the present invention.

Referring now to FIG. 1, the block circuitry of an electronic metronome according to the instant invention is illustrated and generally designated by the reference numeral 10. The electronic metronome 10 provides a realistic tick-tock sound patterns for various time signatures at a rate adjustable between about 20 and 600 beats per minute. The electronic metronome 10 also provides various light patterns for various selectable time signatures by the serial illumination of distinctly colored lights. A range switch and control assembly 12 adjusts the operating frequency of an adjustable oscillator or timer which provides a first, adjustable lower range of beats per minute of the electronic metronome 10 having a range from approximately 20 to 70 beats per minute and a second, adjustable higher range of beats per minute of the electronic metronome 10 having a frequency of between about 50 and 600 beats per minute. The actual frequency of the adjustable oscillator 14, however, is significantly higher than the beats per minute frequencies just recited. The output of the adjustable oscillator 14 is provided to a frequency divider assembly 16 which is configured to divide the output of the adjustable oscillator 14 by 3,300. The output of the frequency divider assembly 16 is thus the actual beats per minute count recited above. The higher frequency output of the adjustable oscillator assembly 14 is also provided to a counter decoder driver assembly 18.

A 3.6047 megaHertz reference frequency is provided by a crystal time base assembly 20. The 3.6047 megaHertz output from the crystal time base 20 is provided to a quintuple divider assembly 22 which provides five reference signals or outputs. First and second outputs preferably having audible frequencies of 1760 Hertz and 3520 Hertz are provided to a tone gate assembly 24. These two frequencies are utilized to provide a synthesized metronome required like "tick" and "tock" sound, respectively. A third output having an audible frequency of 440 Hertz, a standard musical pitch reference frequency, is provided to a beat and tone selector switch 26. A fourth output signal of 27.5 Hertz is provided to the counter, decoder and driver assembly 18. A fifth output having a frequency of 55 Hertz is provided to the comparator and latch assembly 28. The output of the comparator and latch assembly 28 is a logic signal which is provided to the counter, decoder and driver assembly 18 as is the signal from the adjustable oscillator 14 representative of the beats per minute count. The counter, decoder and driver assembly 18 maintains or updates its output in accordance with the logic signal from the comparator and latch assembly 28, and, through a multiplex output, provides signals to a three digit readout assembly 30 which displays the actual beats per minute count.

In addition to being provided to the tone gate assembly 24, the output of the frequency divider assembly 16 is provided to a beat control counter assembly 32. The two just recited assemblies, in conjunction with the beat and tone selector switch 26 select and provide various visual and audible output patterns corresponding to a selected one of several available beats per measure time signatures. The beat and tone selector switch 26 also selects and provides the 440 Hertz reference signal to an audio amplifier 34 which drives a loudspeaker 36. A volume control 38 adjusts the output level of the audio amplifier 34 and the loudspeaker 36. A first, preferably red, light emitting diode 40, a second, preferably yellow, light emitting diode 42 and a third, preferably green, light emitting diode 44 serially illuminate in different patterns corresponding to the selected time signature and their illumination in time with the beats per minute signal provided by the frequency divider assembly 16 is accomplished by a light emitting diode blanking assembly 46.

Figure 2A:
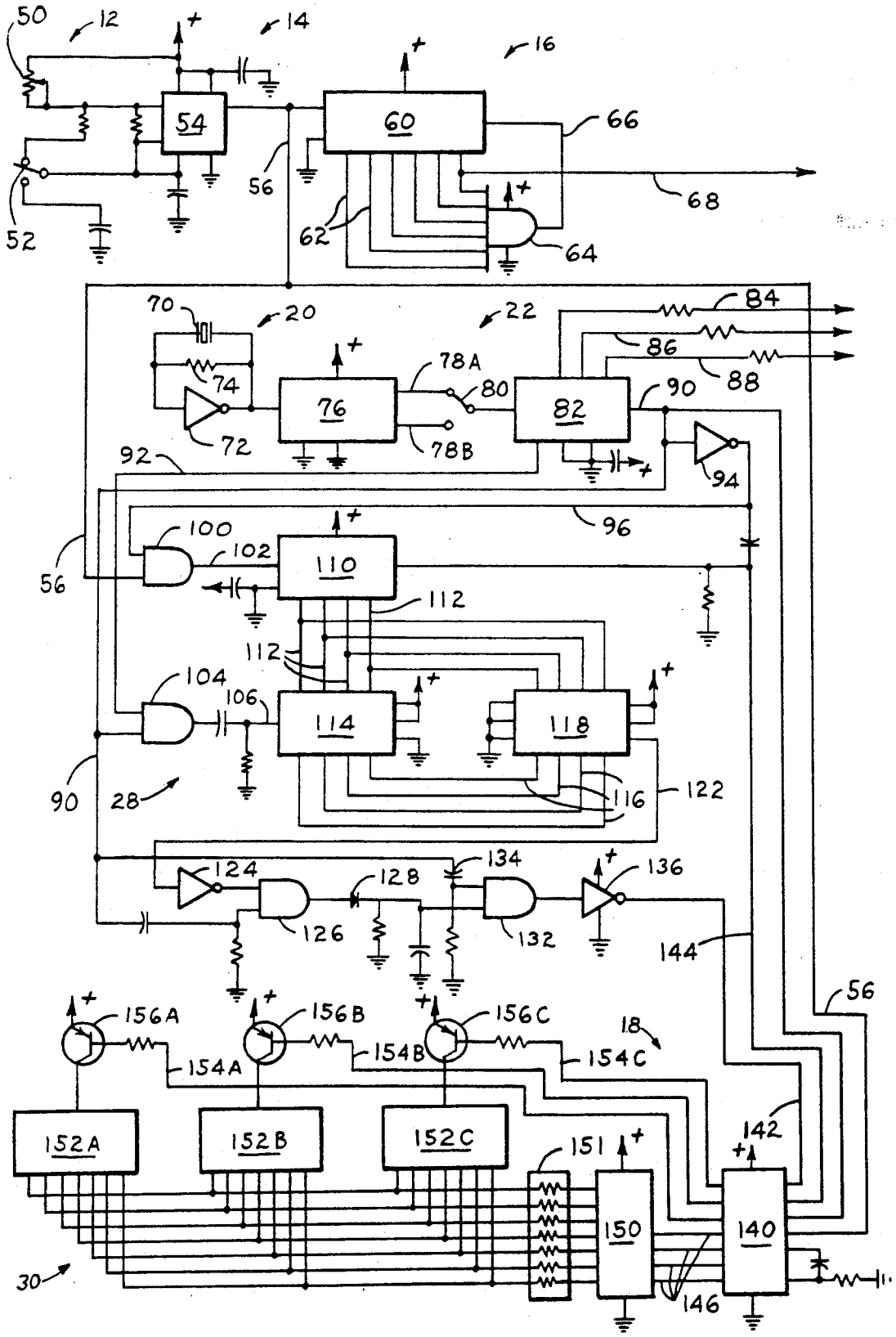
FIG. 2A is a schematic diagram of the adjustable frequency generator and associated divider circuitry, the crystal time base and associated divider circuitry and the beats per minute decoder, latch, driver and seven segment display of an electronic metronome according to the present invention.

Referring now to FIG. 2A, the range switch and control assembly 12 includes a potentiometer 50 which provides substantially continuous adjustment of the beats per minute count of the metronome 10 over two ranges selected by single pole, double throw switch 52. The potentiometer 50 adjusts the magnitude of a control voltage supplied to an adjustable oscillator or timer 54. The timer 54 may be a type 555 integrated circuit or similar device which provides a stable though adjustable pulse train or sinusoidal output. The range switch 52 provides a low beats per minute range for the electronic metronome 10 of approximately 20 to 70 beats per minute. The range switch is illustrated in the high beats per minute range position which provides a beats per minute count from between about 50 to 600. The timer 54, in fact, provides a train of pulses in a line 56 at a rate of between about 65 kiloHertz and 2 megaHertz. This pulse train is provided to the frequency divider assembly 16 and to other components of the metronome 10 as will be subsequently explained.

The frequency divider assembly 16 includes a twelve bit binary counter 60. The binary counter 60 may be an integrated circuit such as a CD 4040 or MC 14040. The twelve bit binary counter 60 includes a plurality of outputs which appear on lines 62 which are all provided to a multiple input AND gate 64. The multiple input AND gate 64 provides an output in a line 66 to the reset input of the binary counter 60 when all of its inputs are high or activated. The binary counter 60 and AND gate 64 are configured such that they provide a divide by 3,300 function to the signal emanating from the timer 54 and thus the output signal of the binary counter in a line 68 corresponds to the actual selected beats per minute count of the metronome 10.

A crystal time base assembly 20 includes a 3.6047 megaHertz crystal 70 and an associated linearizing network consisting of inverting amplifier 72 and resistor 74. The output of the crystal time base assembly 20 is provided to the input of a seven stage ripple counter 76. The ripple counter 76 comprises a portion of the quintuple divider assembly 22 and may be an integrated circuit such as a CD 4024. The ripple counter 76 functions in a manner similar to the frequency divider assembly 16 and provides two reduced frequency outputs in two lines 78A and 78B. The two outputs provide compatibility when using either a 3.6 megaHertz crystal or a 7.2 megaHertz crystal for the crystal 70 when a jumper 80 is appropriately positioned to select the frequency range which matches the frequency of the crystal 70. The reduced frequency output from the seven stage ripple counter 76 is provided to the input of a 14 bit binary counter 82 which comprises the second portion of the quintuple divider assembly 22. The 14 bit binary counter may be an integrated circuit such as a CD 4020. The 14 bit binary counter 82 provides five distinct frequency outputs: a first, lower frequency audible tone of approximately 1760 Hertz in a line 84, a second, higher frequency audible tone having a pitch approximately one octave higher than the signal in the line 84, that is, 3520 Hertz, in a line 86, a musical reference pitch frequency such as 440 Hertz in a line 88, a 27.5 Hertz time base frequency in a line 90 and a second time base reference frequency operating at 55 Hertz, that is, a frequency twice that appearing in line 90, in a line 92. The 27.5 Hertz signal in the line 90 drives an inverting amplifier 94 which provides an inverted time base signal in the line 96.

The comparator and latch assembly 28 will now be described. It includes a first AND gate 100 which receives a signal in the line 56 from the timer 54 and the inverted time base signal in the line 96. When both input signals are present, the AND gate 100 provides a positive or logic high output in the line 102. A second AND gate 104 receives a first input in the line 92 which carries the 55 Hertz time base frequency and a second input, the positive time base signal in the line 90. When these inputs are both high, the second AND gate 104 provides a logic high or positive signal in a line 106.

The signal in the line 102 is provided to the clock input of a twelve bit binary counter 110. The binary counter may be an integrated circuit such as a CD 4040 or MC 14040. The counter 110 provides an output representative of the present operating frequency of the timer 54 which is provided in lines 112 to a quad latch 114. The quad latch 114 may be an integrated circuit such as a CD 4042. The outputs of the quad latch 114 are coupled by lines 116 to one set of inputs of a four bit magnitude comparator 118. The magnitude comparator 118 may be an integrated circuit such as a CD 4063. The other set of inputs of the four bit magnitude comparator 118 receive the signals in the lines 112 from the twelve bit binary counter 110.

The four bit magnitude comparator 118 provides a signal in a line 122 which is a logic high when the instantaneous count in the lines 112 is equal to the count previously stored in the quad latch 114 and a logic low when the count is distinct from the previously stored count thus indicating a change in the frequency of the input to the comparator and latch assembly 28. The logic signals in the line 122 are provided to an inverting buffer 124 which inverts the logic states. The inverting buffer 124 may be one element of a multiple buffer such as a hex buffer integrated circuit such as the type 4049. The output of the inverting buffer 124 is provided to one input of a dual input AND gate 126. The AND gate 126 may be one stage of a quad dual input AND gate integrated circuit such as the type 4081. The other input of the dual input AND gate 126 is coupled through the line 90 to the time base signal provided by the binary counter 82.

When both inputs to the dual input AND gate 126 are high indicating that new data has been detected by the comparator and latch assembly 28 and a time base pulse has been detected, the output of the dual input AND gate 126 is a logic high. The logic high pulse is rectified by a diode 128 and the resulting rectified pulse is smoothed by the capacitor 130 and provided to one input of another dual input AND gate 132. The dual input AND gate 132 may be another segment of a quad dual input AND gate integrated circuit type 4081. The other input of the dual input AND gate 132 is provided with the time base signal on the line 90 through a capacitor 134. Once again when both inputs of the dual input AND gate 132 are high, a logic high output from the dual input AND gate 132 is provided to an inverting buffer 136. The inverting buffer 136 may be another element of the inverting hex buffer type 4049 previously noted. Thus the output signal of the inverting buffer 136 is low when there is a new count detected by the comparator and latch assembly 28 and high when the opposite condition exists.

These logic conditions are fed to the latch enable input of a three digit binary coded decimal (BCD) counter 140 in a line 142. The three digit BCD counter 140 may be an integrated circuit such as an MC 14553B. The three digit BCD counter 140 also receives the output from the adjustable timer 54 in the line 56, the time base signal in the line 90 and an inverted time base signal in the line 144 The timer signal in the line 56 is provided to an enable or start input of the three digit BCD counter 140, the time base signal in the line 90 is provided to the disable or stop input of the three digit BCD counter 140 and the inverted time base signal in the line 144 is provided to the reset input of the three digit BCD counter 140. Binary coded decimal outputs are provided in the lines 146 from the three digit BCD counter 140 to a latch decoder driver 150. The latch decoder driver 150 may be an integrated circuit such as the type MC 14543B. The latch decoder driver 150 provides multiplexed segment outputs through a parallel resistance network 151 to three seven segment light emitting diode readouts 152A, 152B and 152C. The readouts 152A, 152B and 152C may be like or similar to the type 5082-7650. Similarly, the digit activate outputs from the counter 140 are multiplexed and each of the three readouts 152A, 152B and 152C are activated sequentially by logic outputs in the lines 154A, 154B and 154C and conduction of respective driver transistors 156A, 156B and 156C. The seven segment light emitting diode readouts 152A, 152B and 152C thus collectively display the actual beats per minute count selected and resulting from the positions of the potentiometer 50 and range switch 52.

Figure 2B:
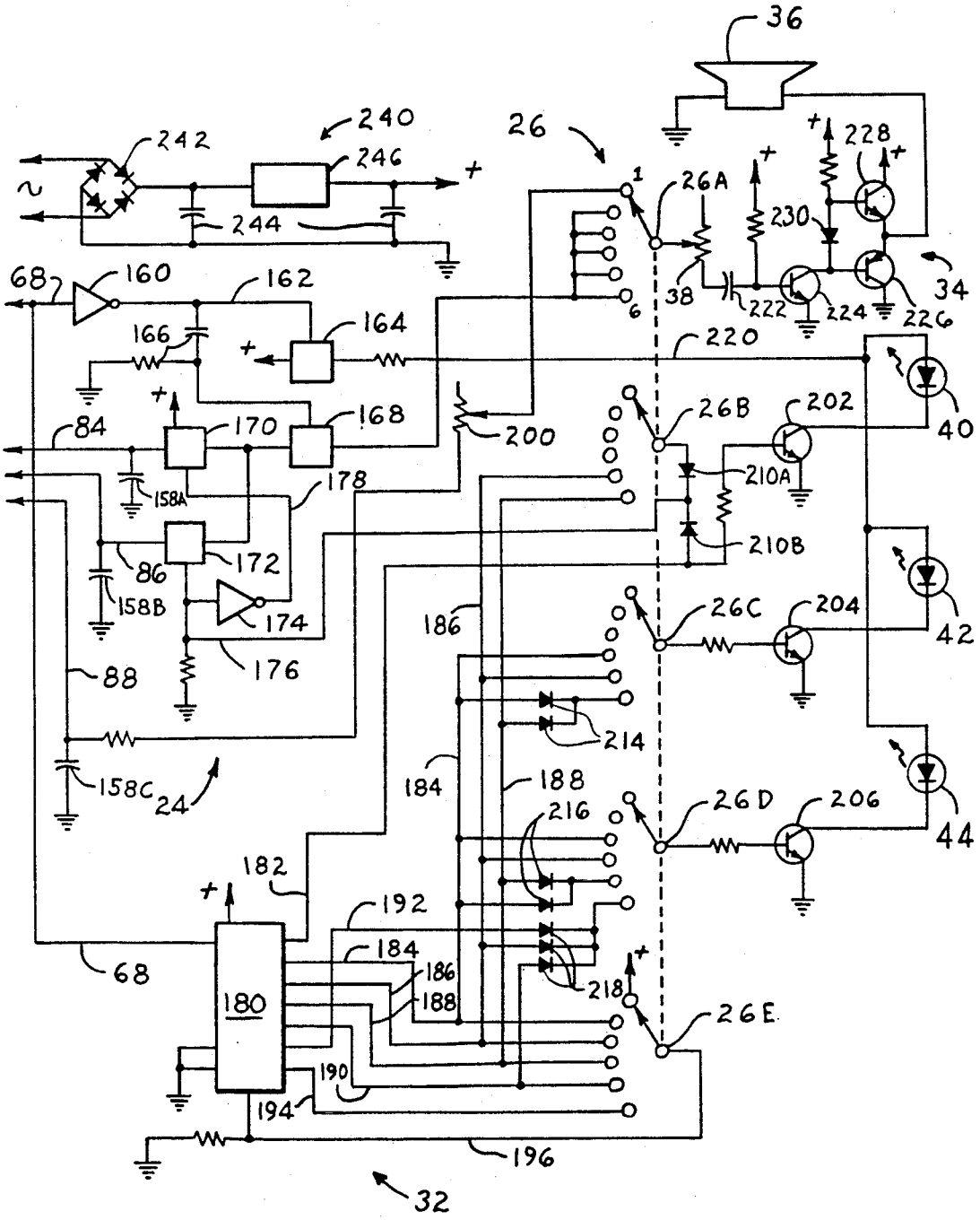
FIG. 2B is a schematic diagram of the logic gate for audio signals, audio amplifier, beats per measure selector switch, display controller and driver and light emitting diode display of an electronic metronome according to the present invention.

Referring now to FIG. 2B, beat gate assembly 24 will now be described. The quality or timbre of the audible frequency signals in the lines 84, 86 and 88 may be adjusted by capacitors 158A, 158B and 158C, respectively. The beats per minute signal or pulse train from the twelve bit binary counter 60 is provided in the line 68 to the input of an inverting buffer 160. The inverting buffer 160 may be one element of an inverting hex buffer such as the type 4049 integrated circuit noted above. The output of the inverting buffer 160 in a line 162 is thus an inverted beats per minute pulse train which is provided to the control input of a analog switch 164 and, through a shaping network 166 consisting of a capacitor and resistor, to another control input of a second analog switch 168. The shaping network 166 provides a sharp, well defined pulse which turns the analog switch 168 on and off in time with the beats per minute pulse. The analog switches 164 and 168 may be elements of a quad analog switch integrated circuit such as the type 4066. The 1760 Hertz signal in the line 84 is provided to an input of a third analog switch 170 and the 3520 Hertz signal in the line 86 is provided to the input of a fourth analog switch 172. The analog switches 170 and 172 may likewise be elements of the type 4066 quad analog switch noted above. An inverting buffer 174 receives a logic signal on a line 176 connected to the control input of the fourth analog switch 172, inverts it and drives the control input of the third analog switch 170 through a line 178. The inverting buffer 174 may be one of the elements of the type 4049 hex buffer integrated circuit noted above. The analog switches 170 and 172 therefore operate in a mutually exclusive manner with one, but only one, of the switches activated and conducting at one time. The analog switch 168 provides the tone selected by the mutually exclusive analog switches 170 and 172 in time with the beat pulses to the selector switch 26.

The beats per minute pulse train n the line 68 is also provided to the clock input of a decade counter divider decoder 180, the major component of the beat control counter assembly 32. The decade counter divider decoder 180 may be an integrated circuit such as the type CD 4017. Each beat or pulse of the input in the line 68 indexes a logic high output signal sequentially through the output lines 182, 184, 186, 188, 190, 192 and 194; only one of the output lines 182, 184, 186, 188, 190, 192 or 194 being in a logic high state at any one time. A pulse on the reset input line 196 of the decade counter divider decoder 180 resets the decade counter divider decoder 180 to the first output line 182 whenever it occurs.

The beat and tone selector switch 26 selects an appropriate tone sequence and sequence and pattern of visible displays to complement a given time signature. The beat and tone selector switch 26 is a five gang, six position selector switch. Each gang of the selector switch 26 drives a specific display element or logic device of the electronic metronome 10 and each position of the selector switch 26 provides a different and unique output display The gangs of the selector switch 26 are illustrated in what will be designated position one. The first gang 26A of the selector switch 26 selects the audible output of the electronic metronome 10. In position number one, the 440 Hertz reference signal appearing in the line 88 is provided to the audio amplifier assembly 34. A potentiometer 200 in the line 88 may be manually adjusted to match the level of the 440 Hertz reference signal with the level of the tones provided by the tone gate assembly 24 so that switching between them with the selector switch 26 will not cause any appreciable change in the output level of the audio amplifier assembly 34 and the loudspeaker 36.

A second gang 26B of the selector switch 26 couples signals in the output lines from the decade counter divider decoder 180 to the tone gate assembly 24 in certain positions. A driver transistor 202 drives the red light emitting diode 40 from pulses in the line 182. The third gang 26C of the selector switch 26 provides and controls signals to a driver transistor 204 which illuminates the yellow light emitting diode 42. The fourth gang 26D of the selector switch 26 likewise provides and controls signals to a driver transistor 206 which illuminates the green light emitting diode 44. The fifth gang 26E of the selector switch 26 is associated with the beat control counter assembly 32 and provides, in accordance with the position of the selector switch 26, a reset pulse to the decade counter divider decoder 180 which resets the counter output as previously described.

Returning to the first gang 26A of the selector switch 200, the first position of the selector switch 26 selects the 440 Hertz reference signal, as noted, and all of the remaining positions, that is, positions two through six of the selector switch 26 connect the output of the analog switch 168 to the audio amplifier assembly 34. The second gang 26B of the selector switch 26 which selects and controls the signals which illuminate the red light emitting diode 40 is quiescent in positions one through four, that is, no signals are provided through the switch contacts. Rather, the pulses in the first output line 182 of the decade counter divider decoder 180 are provided to the driver transistor 202. This pulsing signal is likewise provided through a first blocking diode 210A and through the line 176 to the control input of the analog switch 172 and the input of the inverting buffer 174. In position five, pulses in the third line 186 are provided through a second blocking diode 210B to the line 176 and in position six, pulses from the fourth line 188 of the decade counter divider decoder 180 are provided through the second blocking diode 210B to the line 176.

With regard to the third gang 26C of the selector switch 26 no signals are applied and the driver transistor 204 and light emitting diode 42 are inactive in the first three positions of the selector switch 26. In the fourth position, pulses in the second line 184 from the decade counter divider decoder 180 are provided to the driver transistor 204. In the fifth position of the selector switch 26, pulses in the third output line 186 are provided to the driver transistor 204 and, in the sixth position, pulses in both the lines 184 and 188 are provided, through two blocking diodes 214, to the driver transistor 204.

With regard to the fourth gang 26D of the selector switch 26, the first and second positions are inactive and thus the green light emitting diode 44 is likewise inactive in these switch positions. In the third position, pulses in the second output line 184 from the decade counter divider decoder 180 are provided to the driver transistor 206. In the fourth position of the selector switch 26, pulses in the third line 186 are provided to the driver transistor 206. In the fifth position of the selector switch 26, pulses in the second line 184 and fourth line 188 are provided through a pair of blocking diodes 216 to the driver transistor 206 and, in the sixth position, signal pulses in the sixth line 192, the third line 186 and the fifth line 190 are provided through three blocking diodes 218 to the driver transistor 206.

The fifth gang 26E of the selector switch 26, in the first position, provides power supply voltage to the reset input of the decade counter divider decoder 180 in the line 196. In the second position, of the selector switch 26, a pulse in the second line 184 is returned to the reset line 196; in the third position, a pulse in the third line 186 is returned to the reset line 196. In the fourth position of the selector switch 26, a pulse in the fourth line 188 is returned to the reset line 196; in the fifth position, a reset pulse is provided to the decade toner divider decoder 180 when a pulse appears in the fifth line 190 and in the sixth position of the selector switch 26, the reset line 196 is pulsed when there is a pulse in the seventh line 194.

With reference again to the overall selector switch 26, in positions two through six, sequential flashing of the light emitting diodes 40, 42 and 44 in time with the beat pulses is achieved by the light emitting diode blanking assembly 46 comprising the analog switch 164 in the line 220 common to all anodes of the light emitting diodes 40, 42 and 44. That is, when the analog switch 164 is closed due to a pulse in the line 152, and one of the driver transistors 202, 204 or 206 is conducting, the associated light emitting diode 40, 42 or 44 will illuminate.

Thus the tone gate assembly 24, the selector switch 26, the beat control counter 32, the light emitting diodes 40, 42 and 44, the audio amplifier 34 and the loudspeaker 36 cooperate to provide a variety of visual patterns and tick-tock rhythms.

The pattern of tone pulses, the lower frequency of approximately 1760 Hertz, the "tock", appearing in the line 84 designated "L" and the higher frequency of approximately 3520 Hertz, the "tick", appearing in line 86 designated "H" as well as the various light patterns provided for five time signatures or rhythms namely, one beat per measure, two beats per measure, three beats per measure, four beats per measure and six beats per measure are set forth in the table below.

TABLE I

| Beats Per Measure | Switch Position | Tone Sequence | Line Sequence | Color Sequence | Light Emitting Diode |
|---|---|---|---|---|---|
| — | 1 | — | 88 | — | — |
| 1 | 2 | H | 86 | Red | 40 |
| 2 | 3 | HL | 86, 84 | Red, Green | 40, 44 |
| 3 | 4 | HLL | 86, 84, 84 | Red, Yellow Green | 40, 42, 44 |
| 4 | 5 | HLHL | 86, 84 86, 84, | Red, Green Yellow, Green | 40, 44, 42, 44, |
| 6 | 6 | HLLHLL | 86, 84 84, 86, 84, 84 | Red, Yellow, Green, Yellow Green, Green | 40, 42, 44, 42, 44, 44 |

The output of the first gang 26A in the selector switch 26 is provided to the volume control 38 which is a conventional potentiometer. The volume control 38 provides the audible signal selected by the first gang 26A of the selector switch 26 through a capacitor 222 to the base of a transistor 224. The collector of the transistor 224 is coupled to the base of an output transistor 226. The output transistor 226 is one half of a common emitter coupled transistor pair, the other transistor 228 being driven at its base through a diode 230. The output of the transistors 226 and 228 is provided to a conventional loudspeaker 36.

The electronic metronome also preferably includes a power supply assembly 240 which reduces and rectifies standard line voltage of 120 V.A.C. to 12 V.D.C. or other suitable voltage for use by the circuitry of the electronic metronome 10. Thus the power supply assembly 240 includes a full wave bridge rectifier, storage capacitors 244 and a voltage regulating integrated circuit 246. The voltage regulating integrated circuit 246 may be like or similar to the LM340-12. It will be appreciated that the positive voltage output from the power supply assembly 240 is provided to numerous locations throughout the circuitry of the electronic metronome 10 designated by the combined arrow and plus sign notation.

The foregoing disclosure is the best mode devised by the inventors for practicing this invention. It is apparent, however, that apparatus incorporating modifications and variations will be obvious to one skilled in the art of metronomes. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. An electronic metronome comprising, in combination, adjustable means for providing a beats per minute signal, a crystal time base for providing a pair of audible frequencies and a reference frequency, a frequency counter coupled to an output of said adjustable means for counting the frequency of said adjustable means, a digital display driven by said frequency counter, display stabilizer means for stabilizing said digital display, gate means driven by said beats per minute signal for programmably selecting one of said pair of audible frequencies at a rate determined by said beats per minute signal, a selector switch, three visual indicators, programmable counter means coupled to said selector switch, said gate means and said visual indicators providing sequential time signature displays and an audio amplifier and transducer driven by said gate means for providing audible beat indications whereby said adjustable means may be adjusted to provide a range of beats per minute displayed on said digital display and said selector switch may be adjusted to provide various beats per measure patterns provided by said three visual indicators and said transducer.

2. The electronic metronome of claim 1 wherein said adjustable means for providing a beats per minute signal includes an adjustable frequency oscillator and a frequency divider.

3. The electronic metronome of claim 2 wherein said frequency divider divides by 3300.

4. The electronic metronome of claim 1 wherein said crystal time base also provides a standard pitch frequency of 440 Hertz.

5. The electronic metronome of claim 1 wherein said pair of audible frequencies have a frequency ratio of 2:1.

6. The electronic metronome of claim 1 wherein said pair of audible frequencies are 3520 Hertz and 1760 Hertz.

7. The electronic metronome of claim 1 wherein one of said three visual indicators is red, another of said three visual indicators is green and the other of said three visual indicators is yellow.

8. The electronic metronome of claim 1 wherein said display stabilizer includes a quad latch and a magnitude comparator.

9. The electronic metronome of claim 1 wherein said gate means includes a plurality of analog switches, at least two of said analog switches operating in a mutually exclusive manner.

10. An electronic metronome, comprising, in combination an adjustable oscillator driving a first frequency divider, a crystal time base driving a second frequency divider for generating a pair of audible frequencies, and a time base frequency, a frequency counter means coupled to the output of said adjustable oscillator for counting the frequency of the output of the adjustable oscillator, a digital display, a display stabilizer means for stabilizing the count of the frequency counter, gate means driven by said first frequency divider for programmably selecting one of said pair of audible frequencies at a rate determined by the output frequency of said first frequency divider, a selector switch, three visual indicators, programmable counter means coupled to said selector switch said gate means and said visual indicators for providing sequential time signature displays and an audio amplifier and transducer for providing audible beat indications whereby said adjustable oscillator may be adjusted to provide a range of beats per minute displayed on said digital display and various beats per measure patterns such as single meter and duple meter may be selected by said selector switch and presented in various patterns by said three visual indicators and said transducer.

11. The electronic metronome of claim 10 wherein said adjustable oscillator includes means for providing a first, higher frequency operating range and a second, lower frequency operating range.

12. The electronic metronome of claim 10 wherein said transducer is a loudspeaker.

13. The electronic metronome of claim 10 wherein said pair of audible frequencies are 3520 Hertz and 1760 Hertz.

14. The electronic metronome of claim 10 wherein said display stabilizer includes a quad latch and a magnitude comparator.

15. The electronic metronome of claim 10 wherein said gate means includes a plurality of analog switches, at least two of said analog switches operating in a mutually exclusive manner.

16. The electronic metronome of claim 10 wherein said selector switch defines at least five positions and provides a distinct time signature display by said three visual indicators in each of said five positions.

17. The electronic metronome of claim 10 wherein said selector switch defines at least five positions and provides a distinct audible rhythm pattern to said audio amplifier and transducer in each of said five positions.

18. The electronic metronome of claim 10 wherein said time base accepts crystals having one of two operating frequencies.

19. The electronic metronome of claim 10 wherein said output of said first frequency divider is adjustable between approximately 20 and 600 beats per minute and said digital display includes three digits.

20. An electronic metronome, comprising, in combination an adjustable oscillator driving a first frequency divider for providing a beats per minute signal, a crystal time base driving a second frequency divider for generating a pair of audible frequencies, a standard pitch frequency and a pair of time base frequencies, a frequency counter means coupled to the output of said adjustable oscillator for counting the frequency of the output of the adjustable oscillator, a digital display, a display stabilizer means coupled to one of said time base frequencies for stabilizing the count of the frequency counter and updating said digital display, gate means driven by said first frequency divider for programmably selecting one of said pair of audible frequencies at a rate determined by the output frequency of said first frequency divider, a selector switch, three visual indicators, programmable counter means coupled to said selector switch said gate means and said visual indicators for providing sequential time signature displays and an audio amplifier and loudspeaker for providing audible beat indications whereby said adjustable oscillator may be adjusted to provide a range of beats per minute displayed on said digital display and various beats per measure patterns such as single meter and duple meter may be selected by said selector switch and presented in various patterns by said three visual indicators and said loudspeaker.

* * * * *